US007690077B2

(12) United States Patent
Biere

(10) Patent No.: US 7,690,077 B2
(45) Date of Patent: Apr. 6, 2010

(54) CENTRAL VACUUM UNITS WITH AN ACOUSTIC DAMPING PATHWAY

(75) Inventor: Darin Jay Biere, Webster City, IA (US)

(73) Assignee: Electrolux Home Care Products, Ltd., Cleveland, OH (US)

( * ) Notice: Subject to any disclaimer, the term of this patent is extended or adjusted under 35 U.S.C. 154(b) by 897 days.

(21) Appl. No.: 11/332,903

(22) Filed: Jan. 17, 2006

(65) Prior Publication Data

US 2007/0067948 A1 Mar. 29, 2007

Related U.S. Application Data

(60) Provisional application No. 60/721,449, filed on Sep. 28, 2005.

(51) Int. Cl.
*A47L 9/00* (2006.01)

(52) U.S. Cl. ..... 15/326; 15/314; 15/327.1; 15/412; 15/413

(58) Field of Classification Search ..... 15/314, 15/326, 327.1, 412, 413
See application file for complete search history.

(56) References Cited

U.S. PATENT DOCUMENTS 2,884,185 A 4/1959 Dolan
3,732,667 A 5/1973 Fromknecht et al.
4,114,231 A 9/1978 Nauta
4,120,616 A 10/1978 Dwyer et al.
4,280,245 A 7/1981 Hiester
4,356,591 A 11/1982 Lude
4,361,928 A 12/1982 Schulz
4,665,581 A 5/1987 Oberdorfer
4,938,309 A 7/1990 Emdy
5,400,463 A * 3/1995 Attard et al. ..... 15/326
5,737,797 A 4/1998 Rittmueller et al.
5,813,085 A 9/1998 Fritz et al.
6,192,551 B1 * 2/2001 Roth ..... 15/413
6,363,574 B2 * 4/2002 Worden et al. ..... 15/413
6,611,989 B2 9/2003 Oh et al.
6,779,228 B2 8/2004 Plomteux et al.
6,804,857 B1 10/2004 Olewiler, III
7,076,831 B1 * 7/2006 Ji et al. ..... 15/347

* cited by examiner

*Primary Examiner*—Joseph J Hail, III
*Assistant Examiner*—Shantese McDonald
(74) *Attorney, Agent, or Firm*—Pearne & Gordon LLP

(57) ABSTRACT

Central vacuum units are provided with a canister having a sidewall forming a hollow interior, a vacuum motor disposed within the hollow interior, an exhaust port in fluid communication with the hollow interior, and an acoustic damping pathway. Examples of the acoustic damping pathway can include a plurality of acoustic damping chambers in fluid communication with each other. In addition or alternatively, the acoustic damping pathway can include an inner acoustic damping chamber and an outer acoustic damping chamber. In addition or alternatively, the acoustic damping pathway can form a serpentine passage from the motor to the exhaust port.

23 Claims, 5 Drawing Sheets

CENTRAL VACUUM UNITS WITH AN ACOUSTIC DAMPING PATHWAY

RELATED APPLICATIONS

This application claims the benefit of U.S. Provisional Application No. 60/721,449, filed on Sep. 28, 2005, the entire disclosure of which is hereby incorporated herein by reference.

FIELD OF THE INVENTION

The present invention relates generally to cleaning systems, an more particularly to central vacuum units with an acoustic damping pathway.

BACKGROUND OF THE INVENTION

Built in vacuum systems typically have a central vacuum unit and a system of vacuum ducts which extend into various rooms of a building. Vacuum inlets are typically located in walls of selected rooms so that a vacuum hose can be removably connected to the central vacuum unit during a cleaning operation. To use the central vacuum system, the vacuum hose is plugged into a vacuum inlet servicing the area to be cleaned. The central vacuum unit may then be activated to create a suction force for drawing in dirt and dust through a nozzle attached to the end of the vacuum hose. Conventional central vacuum systems can provide more cleaning power than portable vacuum cleaners and can reduce the necessity of carrying portable vacuum cleaners from room to room. Additionally, central vacuum systems are commonly arranged with the central vacuum unit located in remote areas of the building to reduce noise and/or exhaust from entering certain rooms of the building.

One major disadvantage of known central vacuum systems, however, is the creation of a substantial amount of noise by the central vacuum unit. For example, conventional central vacuum units can generate noise levels in the range of about 75 to about 95 decibels. Such excessive noise levels can be undesirable even though the central vacuum unit is located in a remote area such as the basement or garage of the home. For example, the noise may travel to other areas of the building. Moreover, remote locations are commonly used as playrooms, workshops, etc., where excessive noise levels are unacceptable.

Accordingly, there is a need for central vacuum cleaning systems including a low noise central vacuum unit.

BRIEF SUMMARY OF THE INVENTION

The following presents a simplified summary of the invention in order to provide a basic understanding of some aspects of the invention. This summary is not an extensive overview of the invention. It is intended to identify neither key nor critical elements of the invention nor delineate the scope of the invention. Its sole purpose is to present some concepts of the invention in a simplified form as a prelude to the more detailed description that is presented later.

In accordance with an aspect of the present invention, a central vacuum unit is provided comprising a canister having a sidewall forming a hollow interior and a vacuum motor disposed within the hollow interior. An exhaust port is in fluid communication with the hollow interior and an acoustic damping pathway is formed within the hollow interior. The acoustic damping pathway is adapted to reduce noise produced by the vacuum motor from being emitted through the exhaust port. The pathway includes a plurality of acoustic damping chambers in fluid communication with each other and has portions that are separated from each other by at least one partition substantially circumscribing the vacuum motor.

In accordance with another aspect of the present invention, a central vacuum unit is provided comprising a canister having a sidewall forming a hollow interior and a vacuum motor disposed within the hollow interior. An exhaust port is in fluid communication with the hollow interior and an acoustic damping pathway extends from the vacuum motor to the exhaust port. The acoustic damping pathway is adapted to reduce noise produced by the vacuum motor from being emitted through the exhaust port. The pathway is defined by at least one dividing wall such that the pathway forms a serpentine passage from the motor to the exhaust port.

In accordance with yet another aspect of the present invention, a central vacuum unit is provided comprising a canister having a sidewall forming a hollow interior and a vacuum motor disposed within hollow interior. An exhaust port is in fluid communication with the hollow interior and an acoustic damping pathway is formed within the hollow interior. The acoustic damping pathway is adapted to reduce noise produced by the vacuum motor from being emitted through the exhaust port. The pathway includes an inner acoustic damping chamber in fluid communication with the vacuum motor and an outer acoustic damping chamber in fluid communication with the exhaust port. The inner and outer acoustic damping chambers are at least partially separated by a partition substantially circumscribing the vacuum motor and having an opening formed therein to provide fluid communication between the inner and outer acoustic damping chambers.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
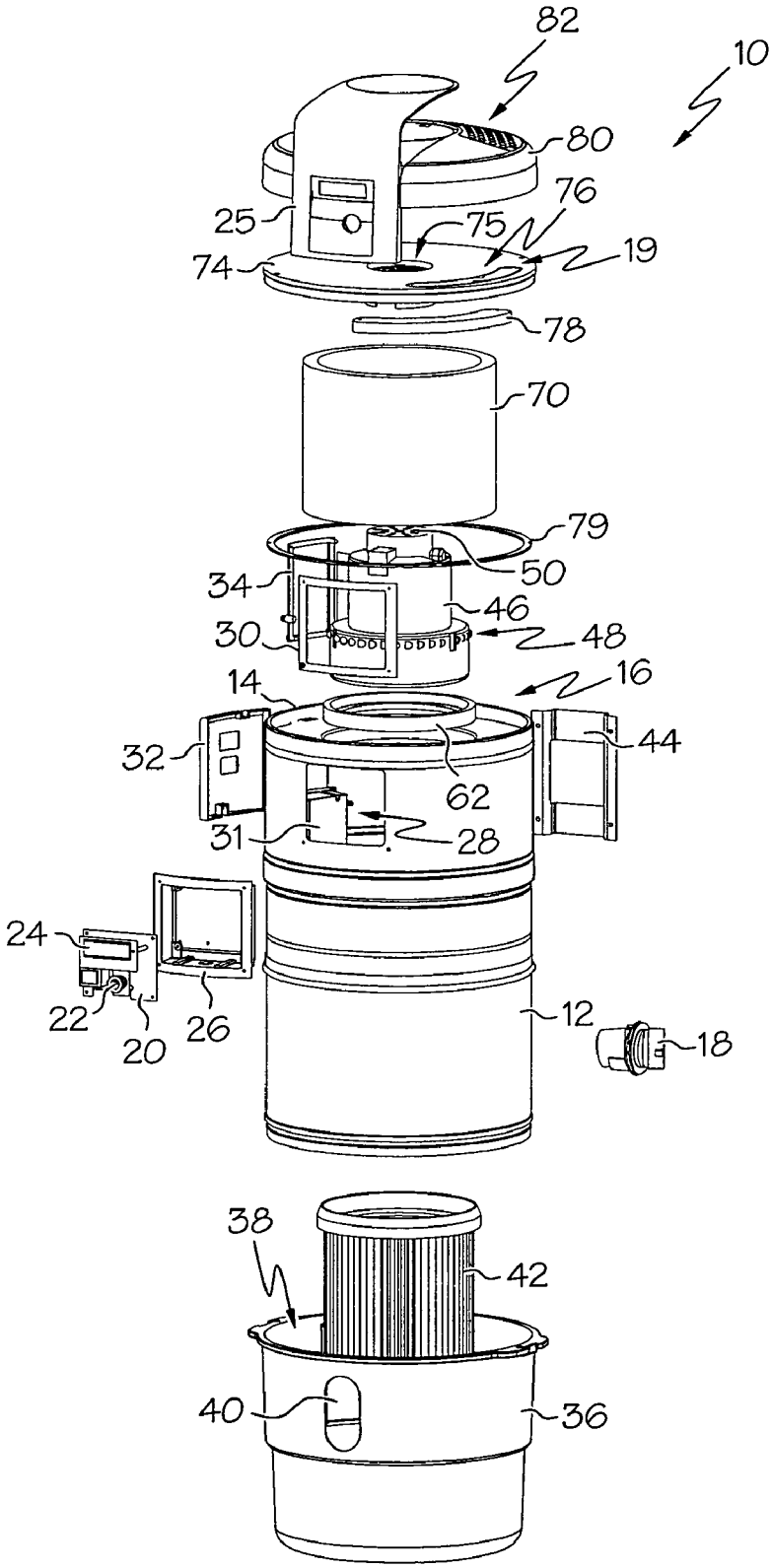
FIG. 1 is a perspective, exploded view of an example central vacuum unit incorporating aspects of the present invention.

An example embodiment of a central vacuum unit that incorporates aspects of the present invention is shown in the drawings. It is to be appreciated that the shown example is not intended to be a limitation on the present invention. For example, one or more aspects of the present invention can be utilized in other embodiments and even other types of central vacuum units.

Turning to the example shown in FIG. 1, a central vacuum unit 10 is illustrated that includes structure to facilitate acoustic damping. The central vacuum unit 10 includes a canister 12 having a sidewall 14 that forms a hollow interior 16. The sidewall 14 may include any rigid material, such as rolled steel, fiberglass, plastic, or the like. The canister 12 can include an air intake port (not shown) in fluid communication with a vacuum hose port 18 located near the bottom of the canister 12. An exhaust port 19 in fluid communication with the hollow interior 16 can be located near the top of the canister 10.

Figure 2:
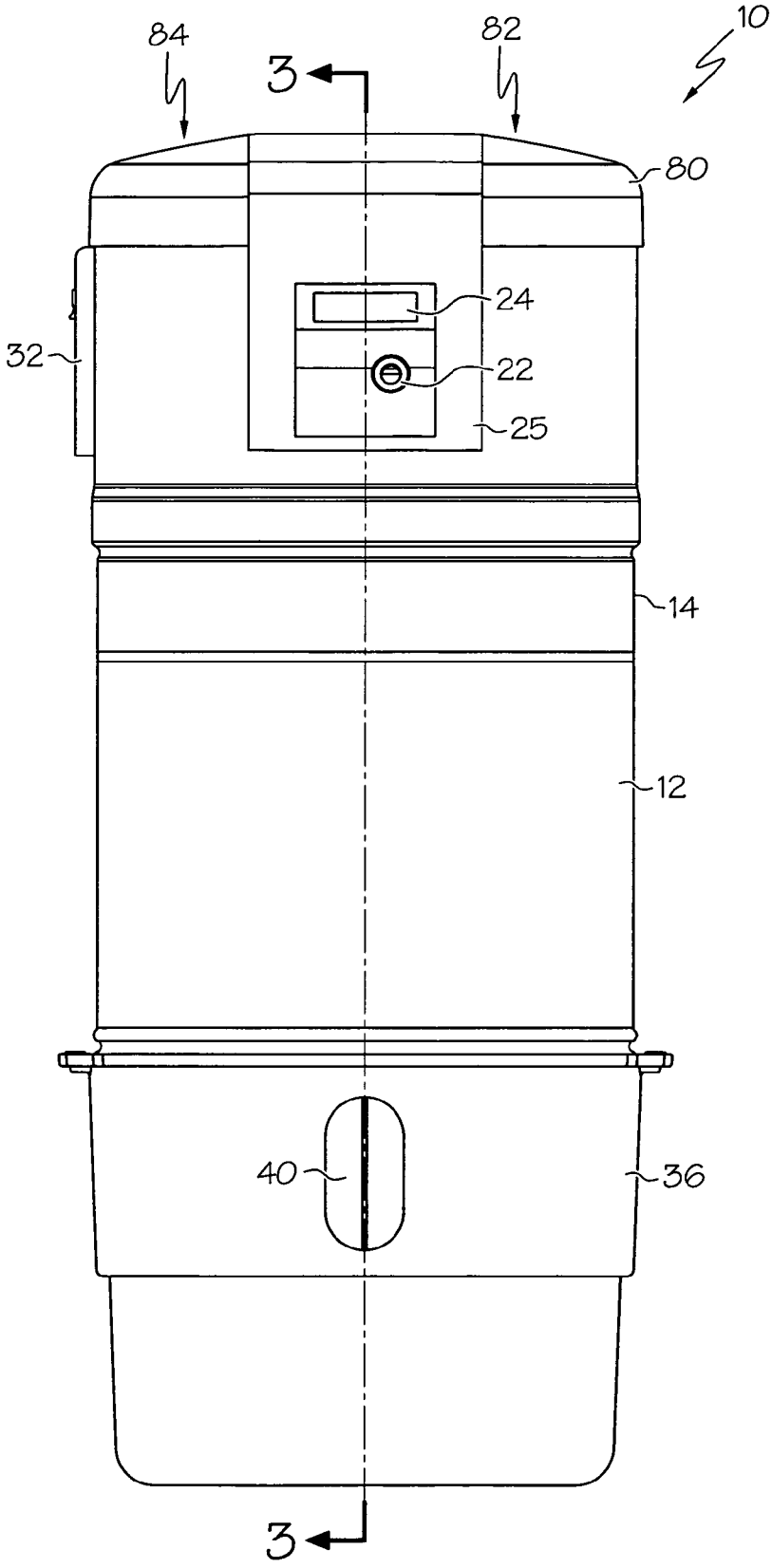
FIG. 2 is a front view of the central vacuum unit of FIG. 1.

The central vacuum unit 10 can also include a control panel 20 to provide a user interface. The control panel 20, if provided, may include an on-off switch 22, and can include other controls. For example, control panel 20 may include a display 24 adapted to display information about the central vacuum unit 10 to a user. In the shown example, the display 24 includes an LCD display, although other types of displays may be incorporated to convey information about the central vacuum unit 10. In the shown example, the control panel 20 is mounted within a housing 26 adapted to be received within a hole 28 in the sidewall 14 of the canister 12. A gasket 30 can also be provided to seal the interface between the housing 26 and the canister 12. As shown in FIG. 2, a faceplate 25 can cover the control panel 20. Returning to the example shown in FIG. 1, the central vacuum unit 10 can further include a power box 31 for receiving power from a conventional power source. For example, the power box 31 can be provided with a power cord for plugging into a conventional wall socket. The power box 31 may include fuses and/or other electrical components (not shown). The power box 31 may be provided with a faceplate 32 and a gasket 34 between the power box 31 and the canister 12.

The central vacuum unit can also include a hollow bucket 36 that may be removably attached to the bottom of the canister 12, for example, by quick-release clips (not shown). The bucket 36 includes a hollow interior 38 adapted to catch and contain debris that has been filtered from the debris-entrained air stream. As shown in FIG. 2, the hollow bucket 36 may include a window 40 adapted to provide a visual indication of the level of debris contained therein.

The central vacuum unit 10 can further include a filter 42. In the shown example, the filter 42 is located within the canister 12 (see FIG. 3). Although not shown, the filter 42 can also extend partially or entirely within the removable hollow bucket. The filter 42 may include a wide variety of filtering mediums adapted to filter debris from the air stream. For example, as shown, the filter 42 may include a cylindrical, pleated air filter 42. In addition or alternatively, the filter 42 can include multiple filters, a HEPA filter, and/or can include a filter bag. As shown, the central vacuum unit 10 can also include a bracket 44 configured to hang the central vacuum unit 10 from a vertical support surface such as a wall.

A vacuum motor 46 can be disposed within hollow interior 16 near the top of the canister 12. An inlet port 47 (see FIG. 3) may be disposed towards the bottom of the motor 46 to draw working air through the filter 42. As shown, the vacuum motor 46 can comprise a peripheral discharge motor with a plurality of radially arranged peripheral vents 48 adapted to radially discharge air into the hollow interior 16. The vacuum motor 46 can also include a cooling fan 50 adapted to draw air in for blowing a cooling air stream over portions of the vacuum motor 46 and then out through vents (not shown) located above vents 48.

Although aspects of the invention may be practiced with a large variety of motors, a peripheral discharge motor can eliminate the need for an exhaust pipe and can allow the vacuum motor 46 to be surrounded by at least portions of an acoustic damping pathway 64. As shown, the acoustic damping pathway 64 can completely surround the motor 46 and can combine the working air (e.g., filtered air) and the cooling air into one exhaust flow. Although not shown, other types of vacuum motors can be used. For example, a tangential discharge motor or other types of motors may be used.

Figure 3:
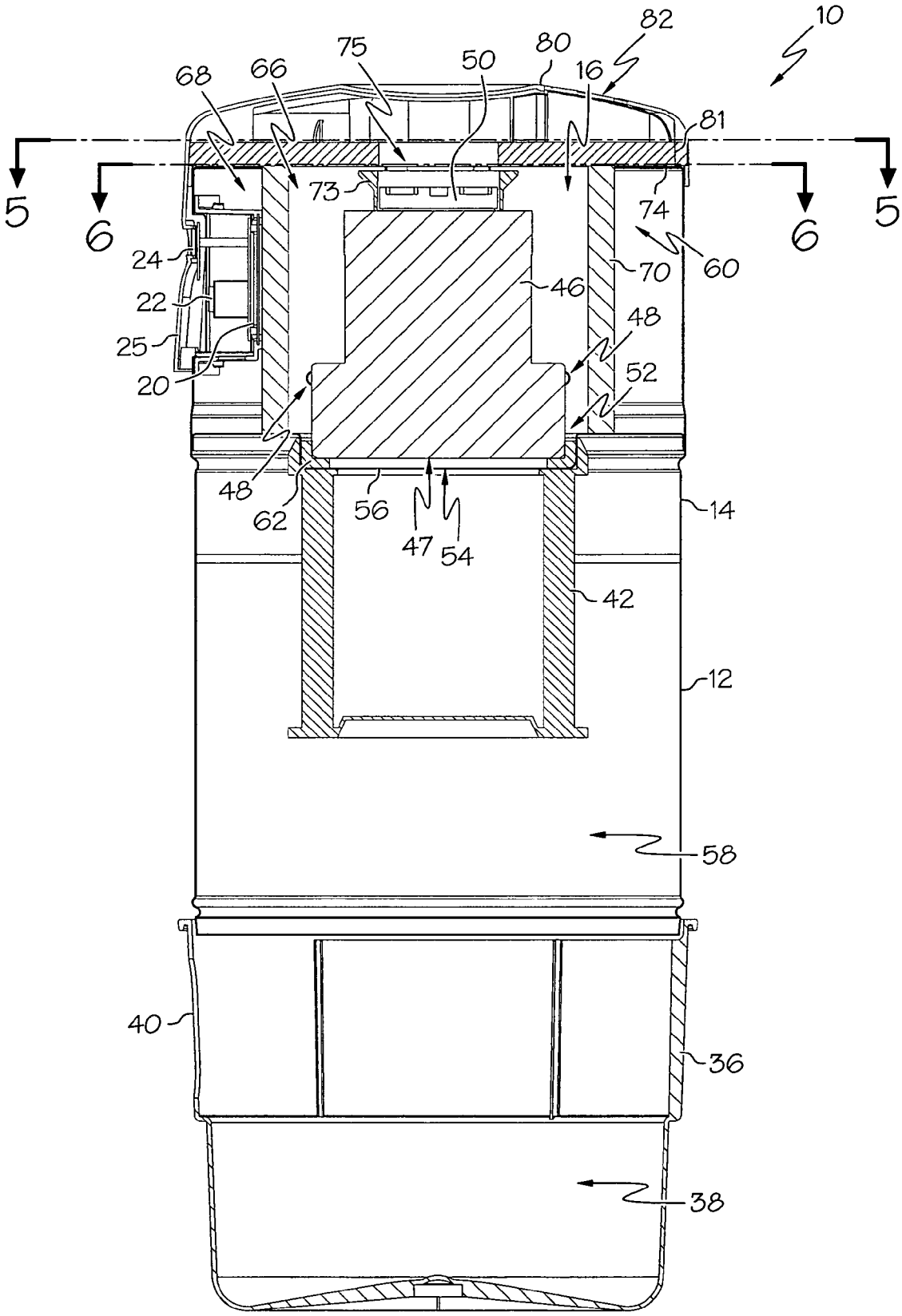
FIG. 3 is a sectional view of the central vacuum unit along line 3-3 of FIG. 2.

As shown in FIG. 3, the vacuum motor 46 is adapted to be mounted within a seat 52 wherein an associated opening 54 is adapted to communicate with the air inlet port 47 of the vacuum motor 46. An additional filter (not shown) can be disposed with respect to the opening 54 to filter the air stream before it enters the inlet port 47 of the vacuum motor 46. In the shown example, the seat 52 is formed in an annular ring 56 that extends across the canister 12 to separate the hollow interior 16 into a lower portion 58 and an upper portion 60. The annular ring 56 can include a screen (not shown) covering the opening 54 to inhibit large debris from passing from the lower portion 58 to the upper portion 60. The vacuum motor 46 can abut a seal 62 disposed within the seat 52 to provide a barrier between the air stream entering the inlet port 47 of the vacuum motor 46 and the air stream exiting the peripheral vents 48.

Figure 6:
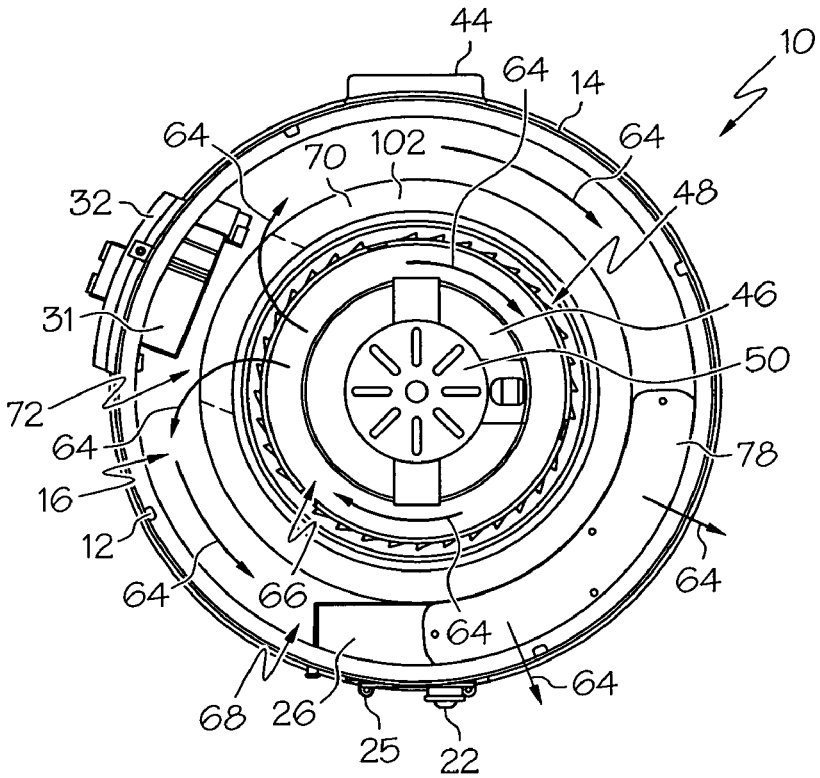
FIG. 6 is a sectional view of the central vacuum unit along line 6-6 of FIG. 3.
Figure 7:
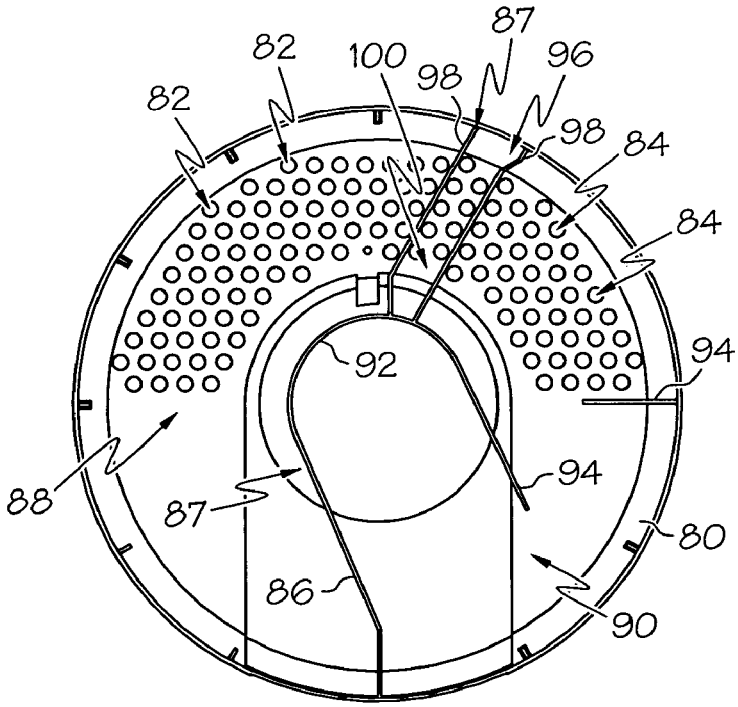
FIG. 7 is a bottom view of an example hood of the central vacuum unit of FIG. 1.

As shown in FIG. 6, the central vacuum unit 10 further includes an acoustic damping pathway 64 formed within the hollow interior 16. The acoustic damping pathway 64 is adapted to reduce noise produced by the vacuum motor 46 from being emitted through the exhaust port 19. The noise can include mechanical noise produced by operation of the motor 46, and/or it can include the pneumatic noise of the air stream produced by operation of the motor 46.

In accordance with one aspect of the present invention, the acoustic damping pathway 64 includes a plurality of acoustic damping chambers in fluid communication with each other. In the shown example, the acoustic damping chambers include an inner acoustic damping chamber 66 and an outer acoustic damping chamber 68. A partition 70 substantially circumscribes the vacuum motor 46 and separates portions of the inner and outer acoustic damping chambers 66, 68 from each other. The partition can extend at various angles. For example, as shown in FIG. 3, the partition 70 can extend vertically between the annular ring 56 and a lid 74 substantially covering an upper end of the canister 12. It is to be appreciated that the partition 70 may also have various geometries as required by the central vacuum unit 10. For example, the partition can have a cylindrical geometry and is concentrically arranged about the vacuum motor. For instance, the partition can have a frustoconical cylindrical geometry that is concentrically arranged about the vacuum motor. In another example, as shown in FIGS. 1 and 6, the partition 70 can have a circular cylindrical geometry that in concentrically arranged about the vacuum motor 46. It will be appreciated that the partition can also include other geometries such that the partition is arranged, for example concentrically arranged, about the vacuum motor.

As shown in the example of FIG. 6, the partition 70 is disposed between the inner and outer acoustic damping chambers 66, 68. Thus, the inner acoustic damping chamber 66 is formed between the vacuum motor 46 and the partition 70, and the outer acoustic damping chamber 68 is formed between the partition 70 and the sidewall 14. As such, the inner acoustic damping chamber 66 is in fluid communication with the vacuum motor 46 and the outer acoustic damping chamber 68 is in fluid communication with the exhaust port 19. It is to be appreciated that additional partitions and/or additional acoustic damping chambers can be provided.

The partition 70 can include a sound absorbing material. Various materials may be used as an acoustic damping material. For example, an open or closed cell foam material may be used. In further examples, a filter material, a natural or synthetic fibrous material, fabric, fiberglass, or other material types may be used for providing a desirable level of acoustic damping. In the shown example, the partition 70 is entirely composed of the sound absorbing material, though the partition 70 may include additional materials and/or components as required, for example, to maintain structural integrity. For example, the partition can include a metal sheet or mesh material provided with sound absorbing material. Moreover, the sound absorbing material may be selected to target reduction of noise within a certain frequency range. In one example, the sound absorbing material can be configured to target noise emissions within the 800 Hz to 1500 Hz ranges, although other ranges are possible depending upon the particular application. It is also to be appreciated that one or more layers of sound absorbing material may be disposed within the inner and/or outer acoustic damping chambers 66, 68 to increase acoustic damping within the respective chambers.

Figure 5:
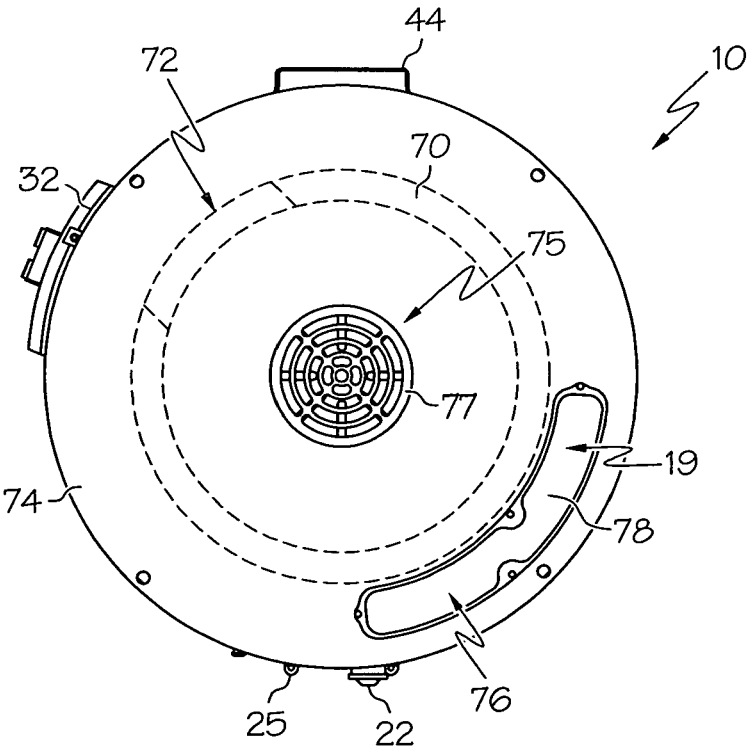
FIG. 5 is a sectional view of the central vacuum unit along line 5-5 of FIG. 3.

Additionally, the partition 70 can include at least one opening 72 to provide fluid communication between the inner and outer acoustic damping chambers. It is to be appreciated that the opening 72 may also permit the passage of various other components of the central vacuum unit 10, such as, for example, electrical wires for providing electric current to the vacuum motor 46. The opening 72 can be oriented away from the exhaust port 19 to increase the length of the acoustic damping pathway 64 for the air stream traveling from the vacuum motor to the exhaust port 19. As shown in the example of FIG. 5, the opening 72 can be oriented at a position that is substantially diametrically opposed to the exhaust port 19 to further increase the length of the acoustic damping pathway 64. Because the sound absorbing material is included along the length of the acoustic damping pathway 64, the level of acoustic damping generally increases as the length of the pathway 64 increases.

As further illustrated, the acoustic damping pathway 64 can extend from the vacuum motor 46 to the exhaust port 19 with the pathway 64 being defined by at least one dividing wall 102. As further shown, the pathway 64 can also form a serpentine passage from the vacuum motor 64 to the exhaust port 19. In the shown example, the partition 70 acts as the dividing wall 102. Thus, as shown, the dividing wall 102 can have cylindrical geometries and can be concentrically arranged about the vacuum motor 46 as described with respect to partition 70 above. The dividing wall 102 may include a wide range of geometries and may be disposed in a variety of ways within the central vacuum unit 10, as previously discussed herein with respect to the partition 70.

It is to be appreciated that the dividing wall 102 may include a sound absorbing material, as previously discussed herein with respect to the partition 70. The dividing wall 102 is designed so that noise from the vacuum motor 46 must travel through the serpentine-shaped pathway 64 before exiting through the exhaust port 19. Thus, the acoustical noise produced by the vacuum motor is forced to be in contact with a sound absorbing material along the designed serpentine-shaped pathway 64. Additional sound absorbing material can be added along the serpentine pathway 64 as required by specific applications.

A serpentine pathway can comprise a pathway including at least one turn so that the pathway does not extend along the same curve or linear path. Each serpentine pathway can include one or a plurality of turns. It is to be appreciated that the serpentine pathway 64 formed by the dividing wall 102 can also form effective sound absorbing pathways of other shapes. Further, the dividing wall 102 can define a plurality of acoustic damping chambers, and may include at least one opening to provide fluid communication between the acoustic damping chambers. In the shown example, the dividing wall 102 separates the inner and outer acoustic damping chambers 66, 68 from each other, and the opening 70 provides fluid communication between the chambers 66, 68. It is further to be appreciated that additional aspects of the central vacuum unit 10 as previously discussed herein may apply to this aspect of the invention. In the illustrated example, a curved pathway is defined between the vacuum motor 46 and the dividing wall 102. The pathway 64 then turns through the opening 72 of the dividing wall 102. Another curved pathway is defined between the dividing wall 102 and the sidewall 14 of the canister 12. As shown, the turn through the opening 72 can be approximately 180° although other turn angles may be practiced in further examples. As further illustrated, the 180° turn through the opening 72 allows the curved paths to be offset from one another with substantially the same center of curvature. Therefore, a compact serpentine pathway can be created to provide an acoustic damping pathway having an increased length.

The lid 74 substantially covering the end of the canister 12 can include at least one opening 76 defining the exhaust port 19. As shown in FIGS. 1, 5, and 6, the exhaust port 19 can include a filter element 78 to filter the air stream before it passes through the exhaust port 19. As shown, the filter element 78 can be attached to the underside of the lid 74 and can have a portion that extends within the outer acoustic damping chamber 68. Additionally, the lid 74 can include an additional opening 75 to provide fluid communication between the cooling fan 50 of the vacuum motor 46 and the atmosphere. The lid 74 may include a screen 77 in covering relationship with respect to the opening 75 to inhibit debris from entering the cooling fan 50, and may also include a filter (not shown). A seal 79 may be disposed between the lid 74 and the sidewall 14. Additionally, an extension tube 73 may be provided to direct the cooling air stream from the opening 75 to the cooling fan 50. For example, as shown in FIG. 3, the extension tube 73 can have a cylindrical geometry to substantially surround the cooling fan 50, and can be attached to the lid 74.

Figure 4:
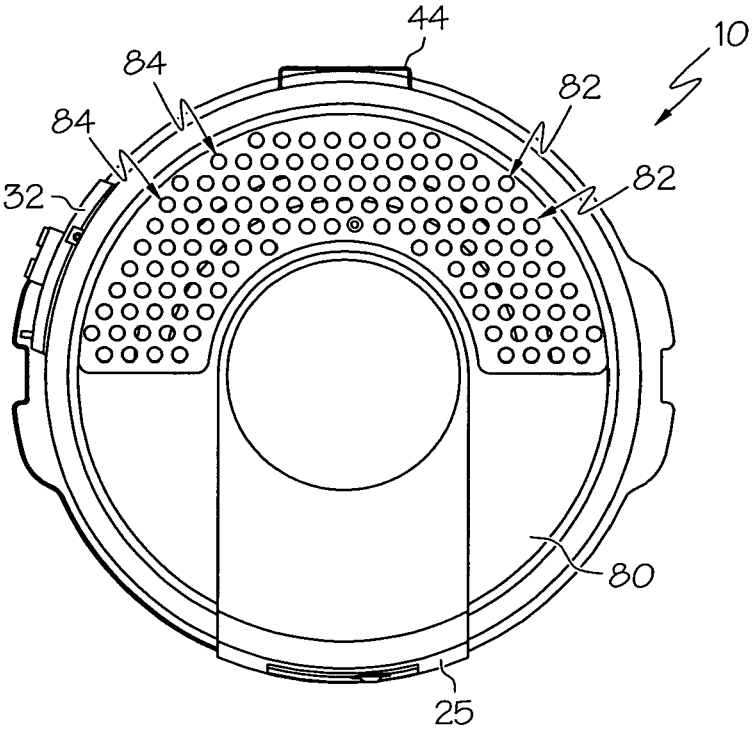
FIG. 4 is a top view of the central vacuum unit of FIG. 1.

The central vacuum unit 10 can further include a hood 80 in covering relationship with respect to the lid 74. As shown in FIG. 3, a buffer material 81, such as a sound absorbing material and/or a sealing material, may be disposed between the lid 74 and the hood 80. The hood 80 may provide an aesthetically pleasing top portion of the central vacuum unit 10, and may also provide an attachment point for the faceplate 25 so that they comprise a single unit. The hood 80 may also include additional structure adapted to interact with the air stream. For example, the hood 80 can include at least one first opening 82 in fluid communication with the exhaust port 19. As shown in FIG. 4, the hood 80 includes a plurality of first openings 82 arranged in an arcuate pattern. The hood 80 may include various numbers of first openings 82 arranged in a variety of different patterns. Additionally, the hood 80 can include at least one second opening 84 in fluid communication with the cooling fan 50 of the vacuum motor 46. As shown in FIG. 4, the hood 80 includes a plurality of second openings 84 arranged in an arcuate pattern. The hood 80 may also include various numbers of second openings 84 arranged in a variety of different patterns.

The central vacuum unit 10 can further comprise structure 86 adapted to inhibit fluid communication between the exhaust port 19 and the cooling fan 50. As shown, the example hood 80 includes the structure 86. Alternatively, the lid 74 can include the structure, or the structure may even exist as an independent component of the central vacuum unit 10. In the shown example, the structure 86 comprises at least one first barrier 87 extending vertically downward from the hood 80 to define the area covered by the hood 80 into a first area 88 and a second area 90. The first area 88 provides fluid communication between the exhaust port 19 and the first openings 82. The second area 90 provides fluid communication between the cooling fan 50 and the second openings 84. The relative sizes of the first and second areas 88, 90 may vary depending upon the particular application. The first barrier 87 may include an arcuate portion 92 adapted to correspond to the second opening 75 in the lid 74 to direct the cooling air stream into the cooling fan 50. The second area 90 may further include at least one second barrier 94 adapted to provide additional acoustic damping for the incoming cooling air stream. As shown, the second area includes a plurality of second barriers 94.

The central vacuum unit 10 can further comprise structure 96 adapted to inhibit fluid communication between the first openings 82 and the second openings 84. As shown, the example hood 80 includes the structure 96. Alternatively, the lid 74 can include the structure, or the structure may even exist as an independent component of the central vacuum unit 10. In the shown example, the structure 96 comprises at least one third barrier 98 extending vertically downward from the hood 80. The third barrier 98 provides separation between the outgoing, exhaust air stream flowing from the first area 88 through the first openings 82 and the incoming, cooling air stream flowing through the second openings 84 to the second area 90. In the shown example, two third barriers 98 are provided to create a dead air space 100 therebetween. The dead air space 100 acts to provide a buffer between the outgoing exhaust air stream and the incoming cooling air stream to thereby inhibit the exhaust air stream from immediately feeding back into central vacuum unit 10. It is to be appreciated that any number of third barriers 98 may be used to create any number of dead air spaces 100 of any size and/or geometry as required.

In operation, the vacuum motor 46 is activated wherein an air stream including entrained debris is drawn into the vacuum hose port 18 of the central vacuum system 10. Simultaneously, the cooling fan 50 draws a cooling air stream through the second openings 84 in the hood 80 and into the vacuum motor 46. Expansion of the debris-entrained air stream within the lower portion 58 of the canister 12 causes relatively larger debris to fall out of the air stream and into the hollow bucket 36. Next, relatively small particulate is further filtered from the air stream as it passes through the filter 42. The filtered air stream then passes through the opening 54 and is received in the air inlet port 47 of the vacuum motor 46. The air passing through the air inlet port 47 and the air stream drawn by the cooling fan 50 are then simultaneously radially discharged into the inner acoustic damping chamber 66. Discharged air then travels along the acoustic damping pathway 64. Thus, the combined air streams travel within the inner acoustic damping chamber 66 wherein acoustic energy is absorbed by the sound absorbing material of the partition 70. The combined air streams then pass through the opening 72 in the partition 70 and turn into the outer acoustic damping chamber 68. The combined air stream then travel in the opposite direction, through the outer acoustic damping chamber 68, wherein acoustic energy is further absorbed by the sound absorbing material of the partition 70. It is to be appreciated that acoustic energy may further be absorbed by any additional sound absorbing material disposed within the inner and/or outer acoustic damping chambers 66, 68. The combined air stream then travels through the filter element 81 and the exhaust vent 19. Finally, the filtered and acoustically dampened air stream travels through the first openings 82 in the hood and is thereafter disbursed to the surrounding environment.

The invention has been described with reference to example embodiments. Obviously, modifications and alterations will occur to others upon a reading and understanding of this specification. It is intended to include all such modifications and alterations insofar as they come within the scope of the appended claims or the equivalents thereof.

What is claimed is:

1. A central vacuum unit configured to remove debris entrained in an air stream comprising:

a canister having a sidewall forming a hollow interior;

a vacuum motor disposed within the hollow interior;

an exhaust port in fluid communication with the hollow interior; and an acoustic damping pathway formed within the hollow interior and adapted to receive the air stream from the vacuum motor and reduce noise produced by the vacuum motor from being emitted through the exhaust port, the pathway including a plurality of acoustic damping chambers in fluid communication with each other and having portions that are separated from each other by at least one partition substantially circumscribing the vacuum motor, the partition including at least one opening to provide fluid communication between the acoustic damping chambers, wherein the at least one opening is oriented at a position that is substantially diametrically opposed to the exhaust port such that the vacuum motor is disposed between the at least one opening and the exhaust port.

2. The central vacuum unit of claim 1, wherein the partition has a cylindrical geometry and is concentrically arranged about the vacuum motor, wherein the at least one opening is oriented at a position that is substantially diametrically opposed with respect to a concentric center of the partition and the vacuum motor.

3. The central vacuum unit of claim 1, wherein the partition includes a sound absorbing material.

4. The central vacuum unit of claim 1, wherein the exhaust port includes a filter element.

5. The central vacuum unit of claim 1, further comprising a lid substantially covering an end of the canister and having at least one opening defining the exhaust port.

6. The central vacuum unit of claim 1, wherein the acoustic damping pathway is configured to divide an air stream passing through the at least one opening to travel in opposite circumferential directions about the partition.

7. A central vacuum unit comprising:

a canister having a sidewall forming a hollow interior;

a vacuum motor disposed within the hollow interior;

an exhaust port in fluid communication with the hollow interior;

an acoustic damping pathway formed within the hollow interior and adapted to reduce noise produced by the vacuum motor from being emitted through the exhaust port, the pathway including a plurality of acoustic damping chambers in fluid communication with each other and having portions that are separated from each other by at least one partition substantially circumscribing the vacuum motor;

a lid substantially covering an end of the canister and having at least one opening defining the exhaust port; and a hood in covering relationship with respect to the lid and having at least one first opening in fluid communication with the exhaust port.

8. The central vacuum unit of claim 7, wherein the motor includes a cooling fan adapted to provide cooling air to the motor and wherein the hood has at least one second opening in fluid communication with the cooling fan.

9. The central vacuum unit of claim 8, further comprising structure adapted to inhibit fluid communication between the exhaust port and the cooling fan.

10. The central vacuum unit of claim 8, further comprising structure adapted to inhibit fluid communication between the at least one first opening and the at least one second opening.

11. A central vacuum unit configured to remove debris entrained in an air stream comprising:

a canister having a sidewall forming a hollow interior;

a vacuum motor disposed within the hollow interior;

an exhaust port in fluid communication with the hollow interior; and an acoustic damping pathway extending from the vacuum motor to the exhaust port and adapted to receive the air stream from the vacuum motor and reduce noise produced by the vacuum motor from being emitted through the exhaust port, wherein the pathway is defined by at least one dividing wall such that the pathway forms a serpentine passage from the motor to the exhaust port, the dividing wall defining a plurality of acoustic damping chambers and including at least one opening to provide fluid communication between the acoustic damping chambers, wherein the at least one opening is oriented at a position that is substantially diametrically opposed to the exhaust port such that the vacuum motor is disposed between the at least one opening and the exhaust port.

12. The central vacuum unit of claim 11, wherein the dividing wall has a cylindrical geometry and is concentrically arranged about the vacuum motor, wherein the at least one opening is oriented at a position that is substantially diametrically opposed with respect to a concentric center of the dividing wall and the vacuum motor.

13. The central vacuum unit of claim 11, wherein the dividing wall includes a sound absorbing material.

14. The central vacuum unit of claim 11, further comprising a lid substantially covering an end of the canister and having at least one opening defining the exhaust port, and a hood in covering relationship with respect to the lid and having at least one first opening in fluid communication with the exhaust port.

15. The central vacuum unit of claim 14, wherein the motor includes a cooling fan adapted to provide cooling air to the motor and wherein the hood has at least one second opening in fluid communication with the cooling fan.

16. The central vacuum unit of claim 15, further comprising structure adapted to inhibit fluid communication between the exhaust port and the cooling fan.

17. The central vacuum unit of claim 11, wherein the acoustic damping pathway is configured to divide an air stream passing through the at least one opening to travel in opposite circumferential directions about the dividing wall.

18. A central vacuum unit configured to remove debris entrained in an air stream comprising:

a canister having a sidewall forming a hollow interior;

a vacuum motor disposed within hollow interior;

an exhaust port in fluid communication with the hollow interior; and an acoustic damping pathway formed within the hollow interior and adapted to receive the air stream from the vacuum motor and reduce noise produced by the vacuum motor from being emitted through the exhaust port, the pathway including an inner acoustic damping chamber in fluid communication with the vacuum motor and an outer acoustic damping chamber in fluid communication with the exhaust port, wherein the inner and outer acoustic damping chambers are at least partially separated by a partition sub substantially circumscribing the vacuum motor and having an opening formed therein to provide fluid communication between the inner and outer acoustic damping chambers, and wherein the opening formed in the partition is oriented at a position that is substantially diametrically opposed to the exhaust port such that the vacuum motor is disposed between the opening and the exhaust port.

19. The central vacuum unit of claim 18, wherein the inner acoustic damping chamber is formed between the motor and the partition, and the outer acoustic damping chamber is formed between the partition and the sidewall.

20. The central vacuum unit of claim 18, wherein the partition has a cylindrical geometry and is concentrically arranged about the vacuum motor, wherein the opening is oriented at a position that is substantially diametrically opposed with respect to a concentric center of the partition and the vacuum motor.

21. The central vacuum unit of claim 18, further comprising a lid substantially covering an end of the canister and having at least one opening defining the exhaust port, and a hood in covering relationship with respect to the lid and having at least one first opening in fluid communication with the exhaust port.

22. The central vacuum unit of claim 21, wherein the motor includes a cooling fan adapted to provide cooling air to the motor and wherein the hood has at least one second opening in fluid communication with the cooling fan.

23. The central vacuum unit of claim 18, wherein the acoustic damping pathway is configured to divide an air stream passing through the opening to travel in opposite circumferential directions about the partition.

* * * * *